US012799419B2

(12) United States Patent
Bonta

(10) Patent No.: US 12,799,419 B2
(45) Date of Patent: Nov. 17, 2026

(54) LITHIUM/CALCIUM SULFONATE MIXED BASE LUBRICATING GREASE

(71) Applicant: VGP IPCO LLC, Lexington, KY (US)

(72) Inventor: Jacob Bonta, Lexington, KY (US)

(73) Assignee: VGP IPCO LLC, Lexington, KY (US)

( * ) Notice: Subject to any disclaimer, the term of this patent is extended or adjusted under 35 U.S.C. 154(b) by 0 days.

(21) Appl. No.: 19/010,793

(22) Filed: Jan. 6, 2025

(65) Prior Publication Data

US 2025/0223507 A1 Jul. 10, 2025

Related U.S. Application Data

(60) Provisional application No. 63/617,911, filed on Jan. 5, 2024.

(51) Int. Cl.

| | |
|---|---|
| ***C10M 123/00*** | (2006.01) |
| ***C10N 10/02*** | (2006.01) |
| ***C10N 10/04*** | (2006.01) |
| ***C10N 30/06*** | (2006.01) |
| ***C10N 50/10*** | (2006.01) |
| ***C10N 70/00*** | (2006.01) |

(52) U.S. Cl.

CPC .. *C10M 123/00* (2013.01); *C10M 2207/1285* (2013.01); *C10M 2219/0445* (2013.01); *C10M 2219/046* (2013.01); *C10N 2010/02* (2013.01); *C10N 2010/04* (2013.01); *C10N 2030/06* (2013.01); *C10N 2050/10* (2013.01); *C10N 2070/00* (2013.01)

(58) Field of Classification Search

CPC ..... C10M 123/00; C10M 2207/1285; C10M 2219/0445; C10M 123/046; C10N 2010/02; C10N 2010/04; C10N 2030/06; C10N 2050/10; C10N 2070/00

See application file for complete search history.

(56) References Cited

U.S. PATENT DOCUMENTS

| | | | |
|---|---|---|---|
| 5,023,016 | A | 6/1991 | Gallacher et al. |
| 6,010,985 | A | 1/2000 | Heimann et al. |
| 6,316,392 | B1 | 11/2001 | Heimann et al. |

(Continued)

FOREIGN PATENT DOCUMENTS

| | | | | |
|---|---|---|---|---|
| CN | 100404655 | C | | 7/2008 |
| CN | 102051257 | A | * | 5/2011 |

(Continued)

OTHER PUBLICATIONS

English-language machine translation of CN 102051257 A (Year: 2011).*

English-language machine translation of KR 10-2019-0080725 A (Year: 2019).*

International Search Report and Written Opinion issued in International Patent Application No. PCT/US2025/010437, mailing date Mar. 19, 2025.

*Primary Examiner* — James C Goloboy

(74) *Attorney, Agent, or Firm* — Benesch Friedlander Coplan & Aronoff LLP

(57) ABSTRACT

A lubricating grease is formed by a method including preparing a lithium formulation and cooling the lithium formulation to about 175 degree Celsius (° C.). The method includes preparing a calcium sulfonate formulation and combining the lithium formulation and the calcium sulfonate formulation in proportions appropriate to the desired performance criteria. The method includes mixing the lithium formulation and the calcium sulfonate formulation.

17 Claims, 5 Drawing Sheets

(56) References Cited

U.S. PATENT DOCUMENTS

| | | | | |
|---|---|---|---|---|
| 7,091,161 | B2 | 8/2006 | Oldiges et al. | |
| 7,435,707 | B2 | 10/2008 | Langer et al. | |
| 8,507,421 | B2 * | 8/2013 | Zaki | C10M 113/10 508/519 |
| 8,618,028 | B2 | 12/2013 | Faci et al. | |
| 8,789,623 | B2 | 7/2014 | Duckworth et al. | |
| 10,100,266 | B2 | 10/2018 | Malshe et al. | |
| 10,392,577 | B2 | 8/2019 | Waynick | |
| 2010/0105586 | A1 | 4/2010 | Bodesheim et al. | |
| 2011/0048809 | A1 | 3/2011 | Duckworth et al. | |
| 2011/0190177 | A1 | 8/2011 | Zaki | |
| 2016/0230112 | A1 | 8/2016 | Waynick | |
| 2018/0016516 | A1 | 1/2018 | Sawaguchi et al. | |
| 2022/0056365 | A1 | 2/2022 | Bongardt et al. | |
| 2023/0138681 | A1 * | 5/2023 | Grundei | C10M 105/18 508/481 |

FOREIGN PATENT DOCUMENTS

| | | | | | |
|---|---|---|---|---|---|
| CN | 105199817 | A | | 12/2015 | |
| CN | 104711080 | B | | 5/2018 | |
| EP | 0285711 | A1 | | 10/1988 | |
| EP | 2133407 | A1 | | 12/2009 | |
| JP | 2004091711 | A | | 3/2004 | |
| JP | 2007070461 | A | | 3/2007 | |
| JP | 2009161706 | A | | 7/2009 | |
| JP | 2011012280 | A | | 1/2011 | |
| KR | 20190080725 | A | * | 7/2019 | C10M 113/06 |
| WO | 2017053576 | A2 | | 3/2017 | |
| WO | 2017120000 | A1 | | 7/2017 | |

* cited by examiner

LITHIUM/CALCIUM SULFONATE MIXED BASE LUBRICATING GREASE

CROSS-REFERENCE TO RELATED APPLICATIONS

This application claims priority from U.S. Provisional application No. 63/617,911, filed on Jan. 5, 2024, which is incorporated by reference herein its entirety.

FIELD OF INVENTION

The present disclosure generally relates to a lubricating grease and a method of making the same.

BACKGROUND

There are a wide variety of products and chemistries for lubricating greases, each having its own advantages and drawbacks. Some blended thickener chemistries for greases have been explored. However, the application of blended greases is not widespread across different chemistries because of the incompatibility. For example, aluminum complex soaps are incompatible with lithium soaps and the combination of the two may have negative effects on the structure of the blended product, resulting in over-hardening or excessive softening of the material. There are numerous other examples of incompatibilities of mixed greases. Additionally, combining greases using conventional processes may commonly result in poorer properties of the blend than of the discreet materials themselves.

SUMMARY

In one embodiment, a method for forming a lubricating grease includes preparing a lithium formulation and cooling the lithium formulation to about 175 degree Celsius (° C.). The method includes preparing a calcium sulfonate formulation and combining the lithium formulation and the calcium sulfonate formulation in proportions appropriate to the desired performance criteria. The method includes mixing the lithium formulation and the calcium sulfonate formulation.

A lubricating grease is formed by the method.

The lithium formulation may include lithium soap, lithium and lithium complex greases, lithium 12-hydroxystearate, lithium hydroxide/calcium hydroxide with 12-hydroxystearic acid, or a combination thereof.

The calcium sulfonate formulation may include calcite converted sulfonates with a total base number (TBN) about 300 or about 400.

In one embodiment, a lubricating grease is formed by a process including preparing a lithium formulation, cooling the lithium formulation to about 300 degree Fahrenheit (° F.), preparing a calcium sulfonate formulation, combining the lithium formulation and the calcium sulfonate formulation, and mixing the lithium formulation and the calcium sulfonate formulation.

In another embodiment, a method for forming a lubricating grease includes preparing a lithium formulation, cooling the lithium formulation to about 300 degree Fahrenheit (° F.), preparing a calcium sulfonate formulation, combining the lithium formulation and the calcium sulfonate formulation in proportions appropriate to the desired performance criteria, and mixing the lithium formulation and the calcium sulfonate formulation.

BRIEF DESCRIPTION OF THE DRAWINGS

In the accompanying figures, chemical formulas, chemical structures, and experimental data are given that, together with the detailed description provided below, describe example embodiments.

DETAILED DESCRIPTION

The embodiments described herein are directed to composition and method for combining two grease chemistries. More particularly, the disclosed embodiments are directed to combining lithium-based greases and calcium sulfonate to bring unique benefits that their individual chemistries do not have.

Lithium based greases (e.g., lithium soap and lithium complex greases, lithium 12-hydroxystearate, lithium hydroxide/calcium hydroxide with 12-hydroxystearic acid or etc.) have a wide range of industrial applications and account for majority of greases produced globally. Lithium based greases have many advantageous properties, including reasonable cost, wide availability, ease of manufacture, good mechanical and temperature stability, good low temperature properties and pumpability. However, lithium-based greases also have drawbacks, including poor corrosion protection, poor anti-wear protection, poor extreme pressure protection, and poor water tolerance. Because of this, lithium-based greases may need significant modifications with performance additives to be suitable for most modern applications.

Calcium sulfonate-based greases are used to a much more limited extent in the industry but have grown in usage with new raw material streams becoming available in recent years from various suppliers. Calcium sulfonate-based greases have many advantageous properties, including excellent corrosion resistance, excellent anti-wear protection, good extreme pressure protection, good mechanical stability, excellent temperature stability and excellent water tolerance, without the need for additional performance additives. However, calcium sulfonate-based greases suffer from higher costs, limited availability, poor pumpability, poor low temperature performance, high thickener concentration requirements, and low frictional efficiency.

The disclosed embodiments are directed to combine the advantageous properties of lithium chemistry and calcium sulfonate chemistry to produce materials that maintain the advantages provided from each. The manufacturing process to combine these greases requires a unique approach. The conventional batch processes for manufacturing lithium-based greases and for manufacturing calcium sulfonate-based creases are starkly different. Directly combining the conventional processes would result in a final product that has little to no structure and no utility such as is seen with other incompatibility phenomena.

Figure 1:
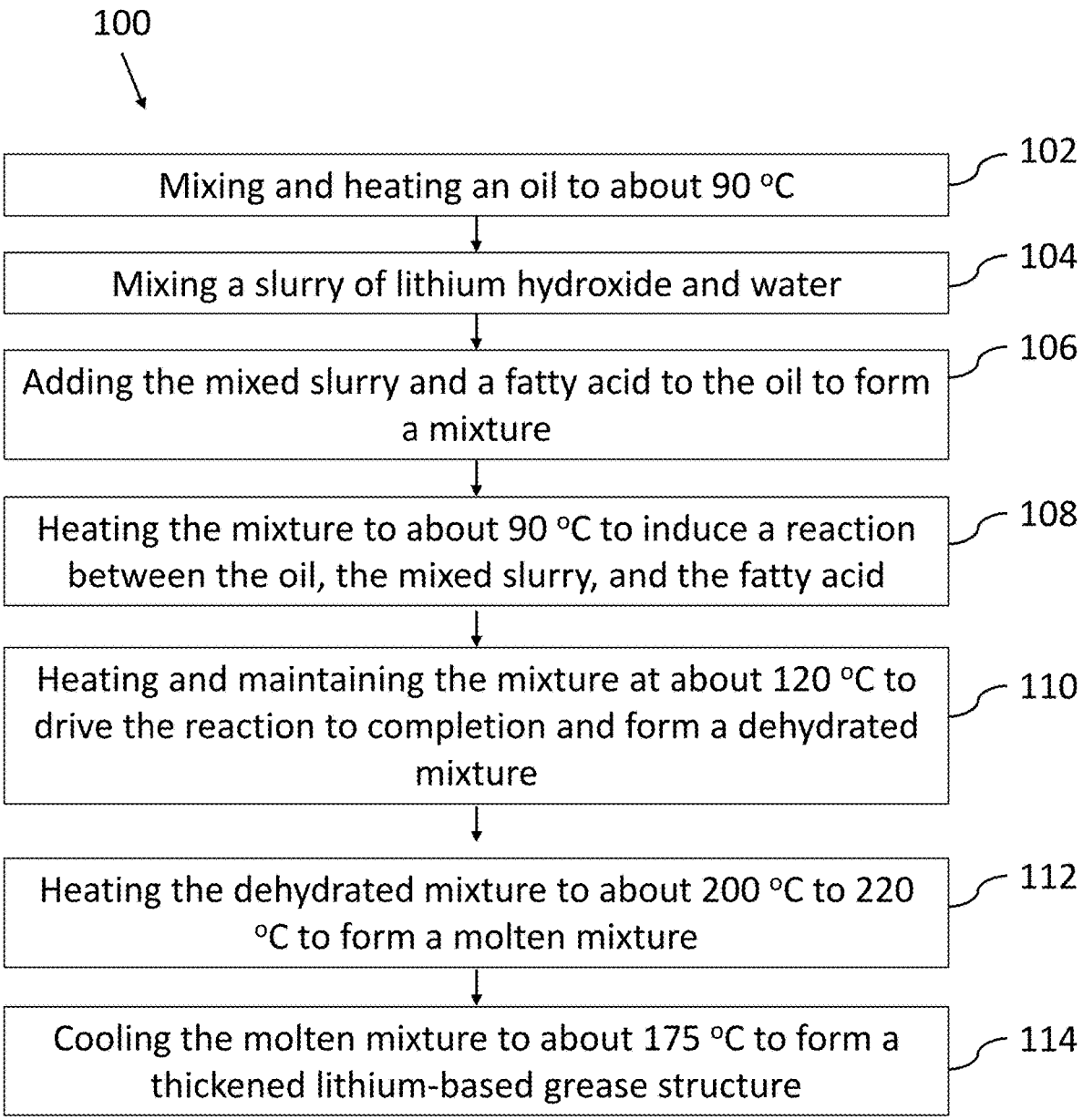
FIG. 1 is an exemplary process for making a lithium-based grease.
Figure 1:
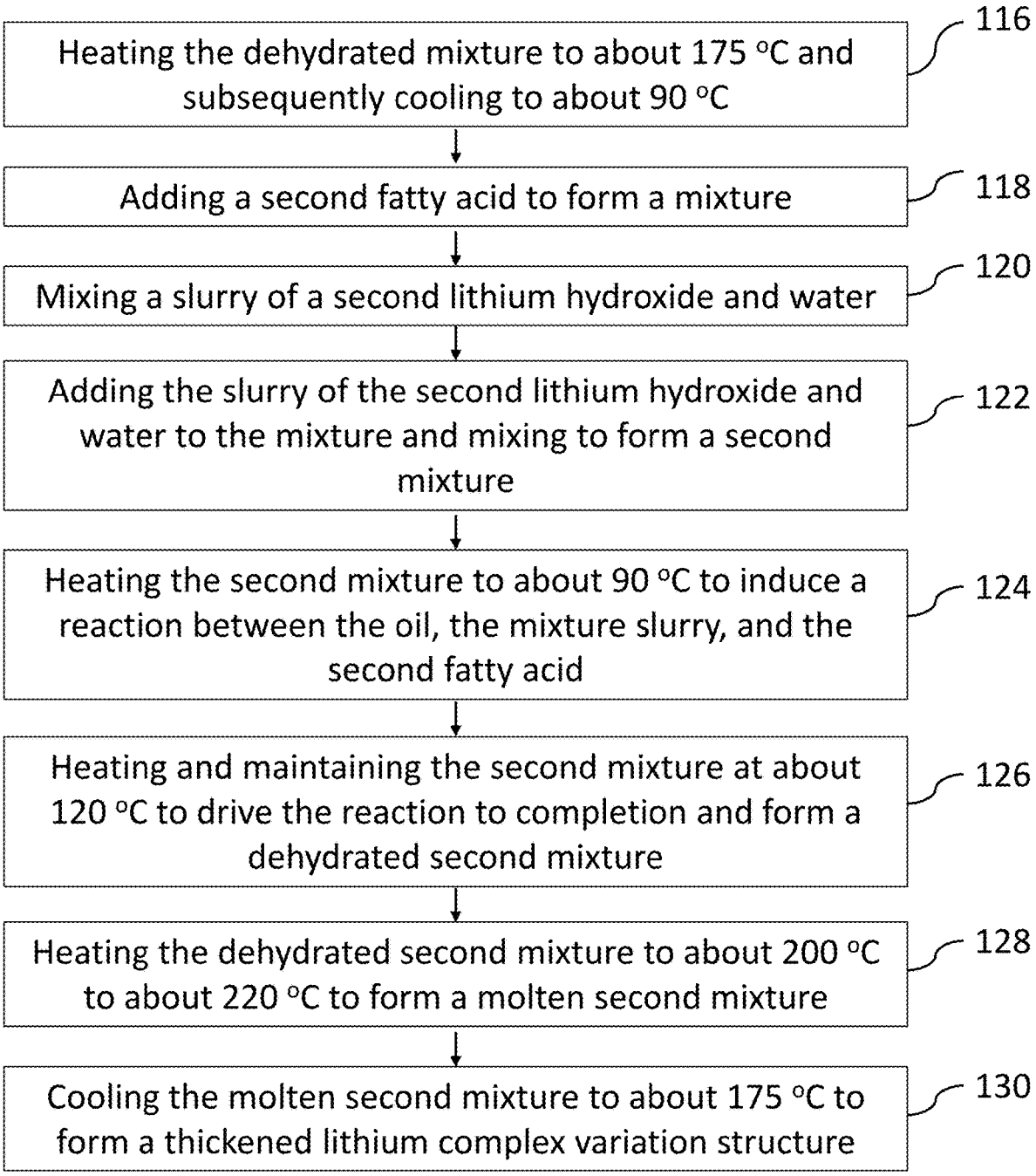

FIG. 1 shows an exemplary process 100 for making lithium-based greases and lithium complex variations.

Formation of Lithium-Based Greases

The process 100 includes mixing and heating an oil in a reaction vessel to about 90 degrees Celsius (° C.) (step 102). The oil may include one or a blend of oils selected from API (American Petroleum Institute) groups I-V categories and may be mineral or synthetic in nature. The amount of oil added to the reaction vessel depends on the target volume of the lithium-based grease. The amount of oil added is predetermined based on the volume capacity of the reaction vessel and the targeted oil concentration in the lithium-based grease produced by the process 100. In some embodiment, the oil added to the reaction vessel in step 102 is about 50% of the total volume of the reaction vessel. In some embodiments, the oil added to the reaction vessel in step 102 may be any appropriate amounts to result in total oil contents about 80% by weight (wt. %) to about 92 wt. % of the final product (e.g., lithium-based grease product in step 114 or lithium complex variation product in step 130).

The process 100 includes mixing a slurry of lithium hydroxide and water (step 104). Step 104 includes preparing a slurry of lithium hydroxide and water. The amount of lithium hydroxide used is based on the targeted end thickener concentration. For example, the amount of lithium hydroxide used is in stoichiometric proportion to the amount of fatty acid added (in step 106). The amount of lithium hydroxide may be about 1 wt. % to about 3 wt. % of the lithium-based grease product. The amount of water used is about six times the mass of the lithium hydroxide used. The slurry is mixed with a mixer for about 10 minutes to 15 minutes. The mixing time depends on the shear rate possible in the mixer.

The process 100 includes adding the mixed slurry and a fatty acid to the oil in the reaction vessel to form a mixture (step 106). The fatty acids may include stearic acid, 12-hydroxysteric acid, azelaic acid or adipic acid, or any combinations thereof. The fatty acids may have any suitable chain lengths and configurations. The amount of fatty acid used is based on the targeted end thickener (e.g., soap) concentration. The amount of fatty acid may be about 6 wt. % to 12 wt. % of the lithium-based grease product. The order of adding the mixed slurry and the fatty acid can be varied. For example, in step 106 the mixed slurry may be added to the reaction vessel first and the fatty acid is added subsequently, or vice versa, or the mixed slurry and the fatty acid may be added to the reaction vessel at the same time.

The process 100 includes heating the mixture to about 90° C. to induce a reaction between the oil, the mixed slurry, and the fatty acid (step 108). As the mixed slurry and the fatty acid are added to the reaction vessel, the overall temperature may drop from the original temperature around 90° C. when there is only the oil in the reaction vessel. Thus, in step 108 the mixture is heated to maintain the temperature around 90° C. to ensure sufficient temperature to drive the reaction to form soap molecules.

The process 100 includes heating and maintaining the mixture at about 120° C. to drive the reaction to completion and to form a dehydrated mixture (step 110). The heating rate in step 110 may be in any suitable rates. The reaction between the oil, the mixed slurry of lithium hydroxide and water, and the fatty acid is endothermic and the temperature in step 110 is maintained at about 120° C. until substantially all water is driven off and the reaction is completed. Step 110 may take about 30 minutes to about 1 hour depending on the batch size and equipment capability. At the end of step 110, the water content is reduced from an original level of about 10 wt. % water to about 0 wt. % water in the dehydrated mixture.

The process 100 includes heating the dehydrated mixture to form a molten mixture (step 112). The temperature may be any suitable temperature (about 200° C. to 220° C.) to melt the soap into oil.

The process 100 includes cooling the molten mixture to form a thickened lithium-based grease structure (step 114). The temperature may be any suitable temperature to form a thickened lithium-based grease structure. For example, step 114 may include cooling the molten mixture to about 175 degree-Celsius (° C.). During the cooling process, the soap molecules formed in the reaction steps (steps 108 and 110) self-assemble into agglomerated fibrous structures. The cooling rate in step 114 is controlled to allow efficient formation of the fibrous structures which improves the overall yield (effective thickening from a set amount of soap acting as the thickener). The cooling rate may be about 0.8 degrees Fahrenheit per minute (° F./min) to about 2.8° F./min, about 1.3° F./min to about 2.3° F./min, or about 1.8° F./min. Step 114 may include any suitable conductive and/or convective cooling methods. In some embodiments, effective cooling may be achieved or enhanced by adding additional oil to the molten mixture. The oil added in step 114 is the same kind or type of oil added in step 102, and the amount of additional added can be any appropriate amounts to result in total oil contents about 80 wt. % to about 92 wt. % of the lithium-based grease.

Formation of Lithium Complex Variation

To form lithium complex variation, after the dehydration step (after step 110), instead of step 112, the process 100 proceeds to heating the dehydrated mixture to about 175° C. and subsequently cooling to about 90° C. (step 116).

The process 100 includes adding a second fatty acid to form a mixture (step 118). The second fatty acid may be any short chain di-carboxylic acids or a variation thereof. The amount of second fatty acid added depends on the targeted end thickener concentration. For example, the amount of second fatty acid added may be about 1.5 wt. % to about 4 wt. % of the lithium complex variation. The mixture is mixed for sufficient time to allow sufficient mixing. For example, the mixture may be mixed for about 10 minutes.

The process 100 includes mixing a slurry of a second lithium hydroxide and water (step 120). Step 120 includes preparing a slurry of the second lithium hydroxide and water. The amount of the second lithium hydroxide used is based on the targeted end thickener concentration. For example, the amount of the second lithium hydroxide used is in stoichiometric proportion to the amount of di-carboxylic acid added (in step 118). The amount of the second lithium hydroxide may be about 1 wt. % to about 3 wt. % of the lithium complex variation. The amount of water used is about six times the mass of the second lithium hydroxide used. The slurry is mixed with a mixer for about 10 minutes to 15 minutes. The mixing time depends on the shear rate possible in the mixer.

The process 100 includes adding the slurry of the second lithium hydroxide and water to the mixture formed in step 118 and mixing to form a second mixture (step 122).

The process 100 includes heating the second mixture to about 90° C. to induce a reaction between the oil, the mixed slurry, and the second fatty acid (step 124). As the mixed slurry and the second fatty acid are added to the reaction vessel, the overall temperature may drop from the original temperature around 90° C. when there is only the dehydrated mixture in the reaction vessel. Thus, in step 124 the second mixture is heated to maintain the temperature around 90° C. to ensure sufficient temperature to drive the reaction to form soap molecules.

The process 100 includes heating and maintaining the second mixture at about 120° C. to drive the reaction to completion and to form a dehydrated second mixture (step 126). The heating rate in step 126 may be in any suitable rates. The reaction between the oil, the mixed slurry of the second lithium hydroxide and water, and the second fatty acid is endothermic and the temperature in step 126 is maintained at about 120° C. until substantially all water is driven off and the reaction is completed. Step 126 may take about 30 minutes to about 1 hour depending on the batch size and equipment capability. At the end of step 126, the water content is reduced from an original level of about 10 wt. % water to about 0 wt. % water in the dehydrated mixture.

The process 100 includes heating the dehydrated second mixture to about 200 to 220° C. to form a molten second mixture (step 128). In step 128, the soap is melted into oil.

The process 100 includes cooling the molten second mixture to about 175° C. to form a thickened lithium complex variation structure (step 130). During the cooling process, the soap molecules formed in the reaction steps (steps 126 and 128) self-assemble into agglomerated fibrous structures. The cooling rate in step 130 is controlled to allow efficient formation of the fibrous structures which improves the overall yield (effective thickening from a set amount of soap acting as the thickener). The cooling rate may be about 0.8 degrees Fahrenheit per minute (° F./min) to about 2.8° F./min, about 1.3° F./min to about 2.3° F./min, or about 1.8° F./min. Step 114 may include any suitable conductive and/or convective cooling methods. In some embodiments, effective cooling may be achieved or enhanced by adding additional oil to the molten mixture. The oil added in step 130 is the same kind or type of oil added in step 102, and the amount of additional added can be any appropriate amounts to result in total oil contents about 80 wt. % to about 92 wt. % of the lithium complex variation.

Table 1 shows example formulations of the lithium-based greases and lithium complex variation produced by the process 100 at the end of steps 114 and 130, respectively.

TABLE 1

| Formulations | Lithium-based Grease | Lithium Complex Variation |
|---|---|---|
| | Weight Percent (wt. %) | |
| Base oil | 80-92 | 80-92 |
| First lithium hydroxide | 1-3 | 1-3 |
| First fatty acid | 6-12 | 6-12 |
| Second lithium hydroxide | 0 | 1-3 |
| Second fatty acid | 0 | 6-12 |
| Total | 100 | 100 |

The lithium-based grease (produced at the end of step 114) disclosed herein includes a base oil about 80% to 92% by weight (wt. %), first lithium hydroxide about 1 wt. % to 3 wt. %, and first fatty acid about 6 wt. % to 12 wt. %. The lithium complex variation (produced at the end of step 130) disclosed herein includes a base oil about 80 wt. % to 92 wt. %, first lithium hydroxide about 1 wt. % to 3 wt. %, first fatty acid (e.g., stearic acid, 12-hydroxysteric acid, azelaic acid or adipic acid, or any combinations thereof) about 6 wt. % to 12 wt. %, second lithium hydroxide about 1 wt. % to 3 wt. %, and second fatty acid (e.g., any short chain di-carboxylic acids or a variation thereof) about 6 wt. % to 12 wt. %.

The structural properties of the lithium-based grease (formed in step 114) and the lithium complex variation (formed in step 130) may be characterized by various methods, including dropping point, cone penetration, and many others. The lithium complex variation (formed in step 130) differs from the lithium-based grease (formed in step 114) in its thermal properties. For example, the dropping point of the lithium complex variation (formed in step 130) is about 280° C. while that of the lithium-based grease (formed in step 114) is about 175° C. The dropping point of a grease is the temperature at which the thickener no longer retains the oil and the oil separates substantially from the grease. The dropping point test determines the cohesiveness of the oil and thickener of a grease.

Figure 2:
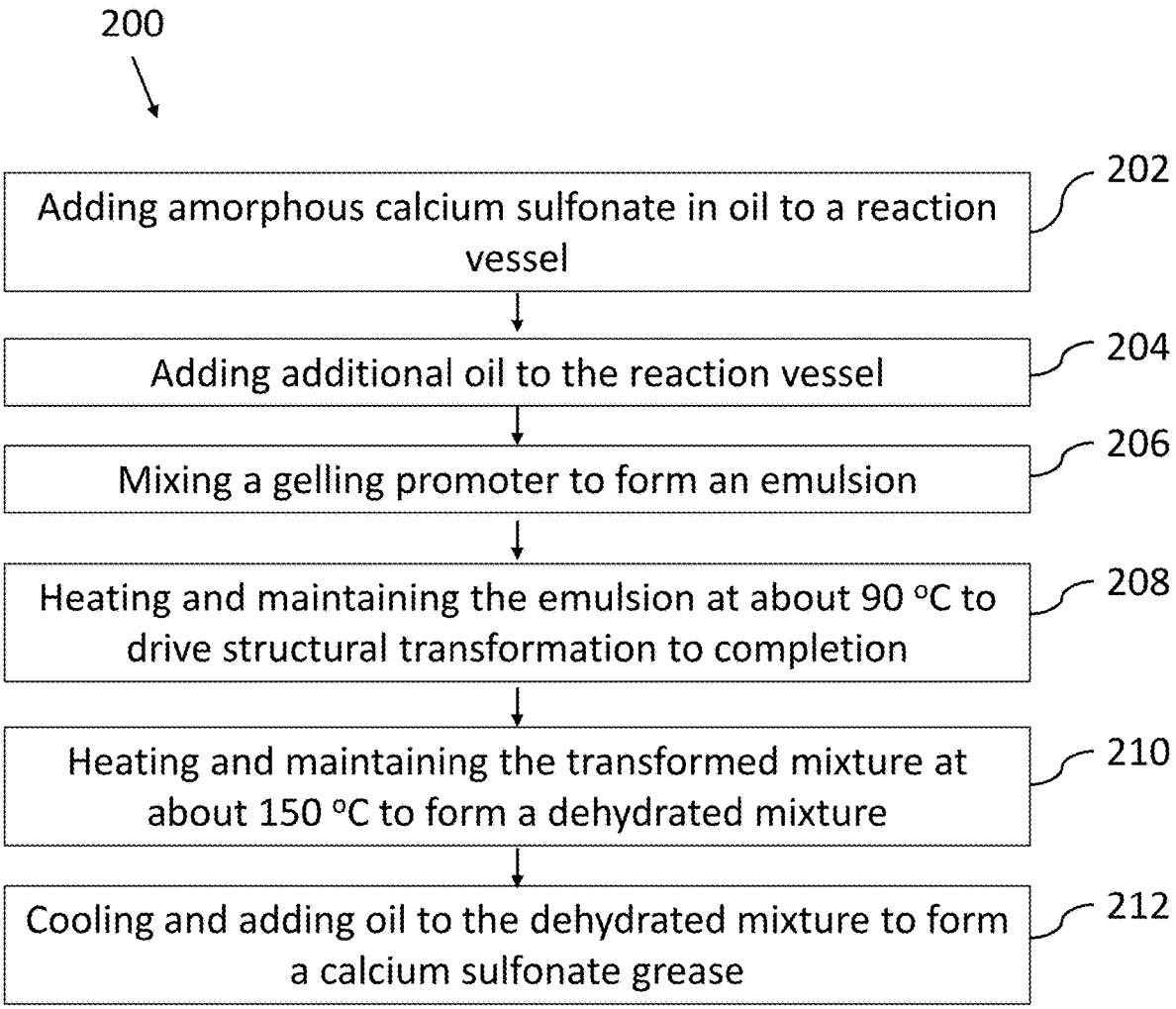
FIG. 2 is an exemplary process for making a calcium sulfonate-based grease.
Figure 2:
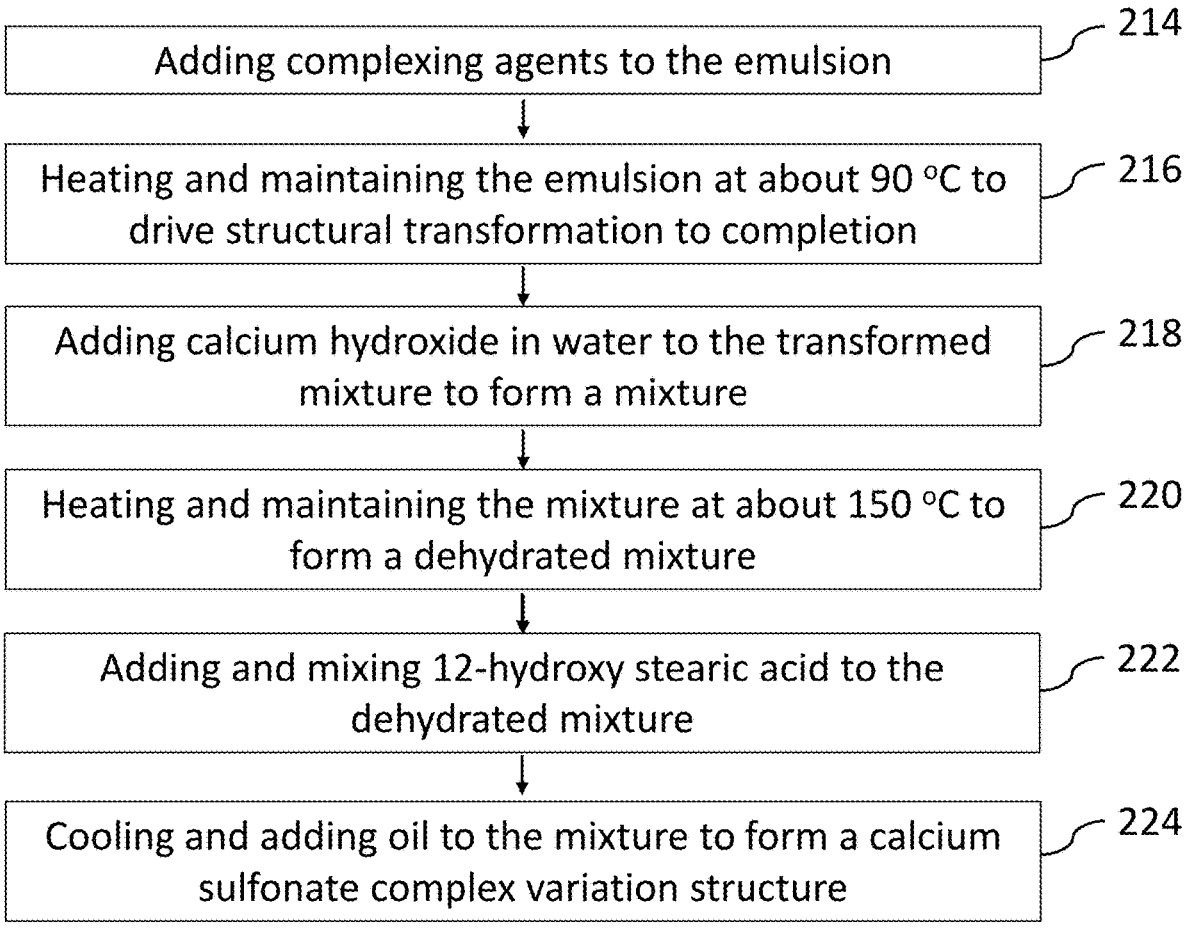

FIG. 2 shows an exemplary process 200 for making calcium sulfonate-based greases/gels and calcium sulfonate complex variation.

Formation of Calcium Sulfonate Grease

The process 200 includes adding amorphous calcium sulfonate in oil to a container or reaction vessel (step 202). The amount of amorphous calcium sulfonate in oil added is about 60% of the batch mass, and as supplied the calcium sulfonate is about 50% calcium sulfonate structural material diluted in oil. The oil may include oils selected from API (American Petroleum Institute) groups I-V categories and may be mineral or synthetic in nature.

The process 200 includes adding additional oil (step 204). The amount of oil added in step 204 is about 20% of the batch mass.

The process 200 includes adding a gelling promoter to the reaction vessel and mixing to form an emulsion (step 206). The gelling promotor can be any suitable highly polar compounds, such as water, propylene glycol, ethylene glycol, glycerol, hexylene glycol, and similar chemicals. The amount of gelling promotor added is about 10% of the batch mass. In one embodiment, water about 10% of the batch mass is added as the gelling promotor.

The process 200 includes heating and maintaining the emulsion at 90° C. to drive structural transformation to completion (step 208). The temperature of emulsion is maintained at about 90° C. for a sufficient length of time to allow completion of structural transformation from an amorphous calcium sulfonate to a crystalline calcite calcium carbonate structure. The completion of the structural transformation is monitored by Fourier transform infrared spectroscopy (FTIR). The emulsion may be held at about 90° C. for about one hour for the structural transformation to complete.

The process 200 includes heating and maintaining the transformed mixture at about 150° C. to form a dehydrated mixture (step 210). The temperature is maintained at about 150° C. for a sufficient length of time to allow complete dehydration of the mixture. The water content is reduced zero or substantially zero in the dehydrated mixture. The transformed mixture may be maintained at about 150° C. for about one hour to complete dehydration of the mixture.

The process 200 includes cooling and adding oil to the dehydrated mixture to form a calcium sulfonate grease or gel (step 212). Step 212 includes removing the heat, adding additional oil to the dehydrated mixture to facilitate cooling and to achieve a target concentration of the calcium sulfonate gel (step 212). The additional oil added is about 11.6 wt. % of the final calcium sulfonate gel.

Calcium Sulfonate Complex Variation

To form calcium sulfonate complex variation, after the emulsion is formed in step 206, instead of step 208, the process 200 proceeds to adding complexing agents to the emulsion (step 214). The complexing agents may include any suitable fatty acids (such as stearic acid, 12-hydroxystearic acid, azelaic acid, and adipic acid), calcium hydroxide, boric acid, arylsulfonic acid, acetic acid, or any combinations thereof. The complexing agents may also be in any suitable chain lengths and configurations. The amount of complexing agents added in step 214 may be about 4.8% of the batch mass. In one embodiment, the complexing agents added in step 214 include acetic acid about 1.8% of the batch mass, arylsulfonic acid about 2.3% of the batch mass, and hexylene glycol about 0.7% of the batch mass.

The process 200 includes heating and maintaining the emulsion at about 90° C. to drive structural transformation to completion (step 216). The temperature is maintained at about 90° C. for a sufficient length of time to allow completion of structural transformation from an amorphous calcium sulfonate to a crystalline calcite calcium carbonate structure. The completion of the structural transformation is monitored by FTIR. The emulsion may be held at about 90° C. for about one hour for the structural transformation to complete.

The process 200 includes adding calcium hydroxide in water to the transformed mixture to form a mixture (step 218). The added calcium hydroxide is about is about 1.4% of the batch mass and water about 3% of the batch mass.

The process 200 includes heating and maintaining the mixture at about 150° C. to form a dehydrated mixture (step 220). The temperature may be maintained at about 150° C. for a sufficient length of time (about one hour) to complete dehydration (free or substantially free of water).

The process 200 includes adding and mixing 12-hydroxy stearic acid to the dehydrated mixture (step 222). The amount of 12-hydroxy stearic acid may be about 2.2% of the batch mass. The mixture is mixed for a sufficient length of time to facilitate the complete reaction between 12-hydroxy stearic acid and the dehydrated mixture. In some embodiment, the mixture is mixed for about one hour. In step 222, the temperature of the mixture is maintained at about 150° C. (as in step 220).

The process 200 includes cooling and adding oil to the mixture (mixture formed in step 222) to form a calcium sulfonate complex variation structure (step 224). Step 224 includes removing the heat, adding additional oil to the mixture to facilitate cooling and to achieve a target concentration of the calcium sulfonate complex variation. During the cooling process, the soap molecules formed in the reaction steps (steps 216 and 218) self-assemble into agglomerated fibrous structures. The cooling rate in step 224 is controlled to allow efficient formation of the fibrous structures which improves the overall yield (effective thickening from a set amount of soaping acting as the thickener). The cooling rate may be about 0.8 degrees Fahrenheit per minute (° F./min) to about 2.8° F./min, about 1.3° F./min to about 2.3° F./min, or about 1.8° F./min. Step 224 may include any suitable conductive and/or convective cooling methods. In some embodiments, effective cooling may be achieved or enhanced by adding additional oil to the molten mixture. The oil added in step 224 is the same kind or type of oil added in step 204, and the amount of additional added can be any appropriate amounts to result in total oil contents about 80 wt. % to about 92 wt. % of the calcium sulfonate complex variation. The oil added in step 224 may be about 11.6% of the batch mass.

Table 2 shows example formulations of the calcium sulfonate grease and calcium sulfonate complex variation produced by the process 200 at the end of steps 212 and 224, respectively.

TABLE 2

| Formulations | Calcium Sulfonate Grease | Calcium Sulfonate Complex Variation |
|---|---|---|
| | Weight Percent (wt. %) | |
| Base oil | 60 | 51.6 |
| Calcium sulfonate | 30 | 30 |
| Gelling promoter | 10 | 10 |

TABLE 2-continued

| Formulations | Calcium Sulfonate Grease | Calcium Sulfonate Complex Variation |
|---|---|---|
| | Weight Percent (wt. %) | |
| Fatty acids | 0 | 4.8 |
| Calcium hydroxide | 0 | 1.4 |
| 12-hydroxystearic acid | 0 | 2.2 |
| Total | 100 | 100 |

The calcium sulfonate grease (produced at the end of step 212) disclosed herein includes a base oil about 50 wt. % to 80 wt. %, calcium sulfonate about 10 wt. % to 40 wt. %, and gelling agents about 4 wt. % to 12 wt. %. The calcium sulfonate complex variation (produced at the end of step 224) disclosed herein includes a base oil about 60 wt. % to 80 wt. %, calcium sulfonate about 20 wt. % to 35 wt. %, gelling promoter about 8 wt. % to 12 wt. %, fatty acids about 3 wt. % to 5 wt. %, calcium hydroxide about 1 wt. % to 3 wt. %, and 12-hydroxystearic acid about 1.5 wt. % to 3 wt. %.

The two processes (processes 100 and 200) described above cannot be directly combined or used together. In particular, the heating process for the lithium-based grease requires a higher top temperature. Differential scanning calorimetry (DSC) studies of these two processes show that around 400° F., the sulfonate structure is irreversibly damaged. It is an inverse micelle of sulfonate surfactants oriented around a calcite crystal structured calcium carbonate core. This high temperature causes destruction of the micelle and thus loss of integrity. Additionally, the nature of the micellar structure of the calcium sulfonate makes the dehydration processes occur at different temperatures and may lead to a longer dehydration step. A longer dehydration step may have oxidative and structural impacts on the material. For reasons set forth above, despite undue experimentation, it has been challenging to develop a system that makes successful calcite conversion and lithium formation in a single batch process (e.g., a single pot scenario).

Figure 3:
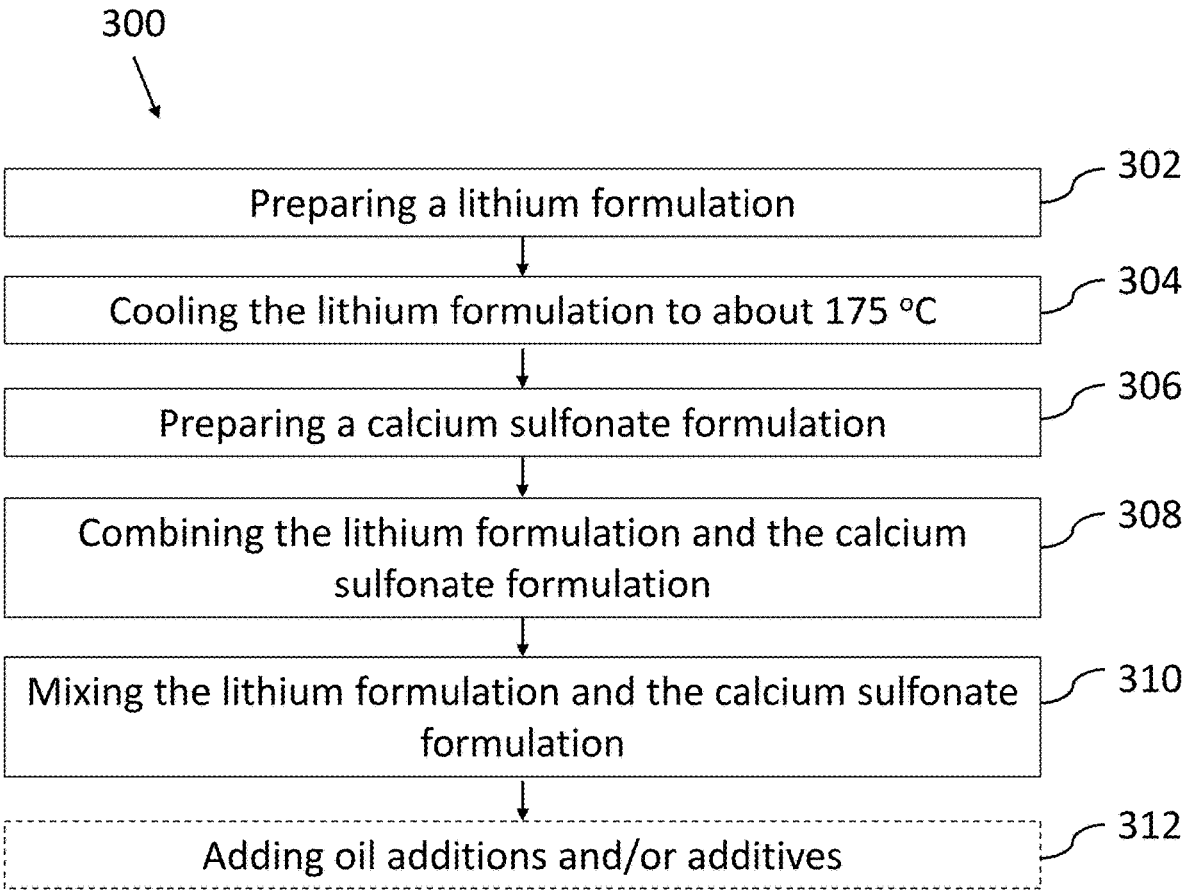
FIG. 3 is an exemplary process for making a lithium and calcium sulfonate mix based lubricating grease.

FIG. 3 is an exemplary process 300 for making lithium and calcium sulfonate mixed base lubricating grease. Process 300 includes preparing a lithium formulation (step 302) and cooling the lithium formulation to about 175° C. (step 304). The lithium formulation includes the lithium-based grease formed in step 114 and/or the lithium complex variation formed in step 130. Step 302 and step 304 include steps described in process 100 and cooling the lithium-based grease to about 175° C. (step 114 or step 130). The cooling rate can be any suitable rate to for the lithium formulation. For example, the cooling rate may be about 0.8° F./min to about 2.8° F./min, about 1.3° F./min to about 2.3° F./min, or about 1.8° F./min.

Process 300 includes preparing a calcium sulfonate formulation (step 306). Step 306 includes steps described in process 200 to form calcite converted sulfonates (calcium sulfonate gel formed in step 212 and/or calcium sulfonate complex variation formed in step 224) with a total base number (TBN) about 300 or about 400. Calcite formation is tracked by FTIR to completion, and then dehydration is performed. As may be appreciated, step 306 may be performed prior to, after, or at the same time as steps 302 and 304. Process 300 includes combining the lithium formulation and the calcium sulfonate formulation (step 308). Process 300 includes mixing the lithium formulation and the calcium sulfonate formulation (step 310). The lithium formulation and the calcium sulfonate formulation may be combined and mixed during the cooling process (e.g., step 114, step 130, step 212, or step 224). Mixing may be achieved using any suitable technique. For example, a planetary mixer may be used to mix to homogeneity. Process 300 may optionally include adding oil additions and/or additives (step 312). In step 312, oil additions may be added to enhance homogeneity and structural stability, and additives may be added as desired once the mixture is cooled to below about 180° F. (or about 80° C.). In some embodiments, no additives are added.

The process 300 is configured to provide a unique processing approach to combine a lithium-based grease and a calcium sulfonate-based grease to form a product that retains the advantageous performance properties of both, in whole or in part, resulting in a superior product at lower cost.

Table 3 shows example formulations of the lithium/calcium sulfonate mixed base lubricating greases produced by the process 300.

TABLE 3

| Formulations | Weight Percent (wt. %) |
|---|---|
| Lithium-based grease | 15-85 |
| Lithium complex variation | 15-85 |
| Calcium sulfonate grease | 15-85 |
| Calcium sulfonate complex variation | 15-85 |

As another example, a lubricating grease disclosed herein is formed by a process including preparing a lithium formulation; cooling the lithium formulation to about 300 degree Fahrenheit (° F.); preparing a calcium sulfonate formulation; combining the lithium formulation and the calcium sulfonate formulation; and mixing the lithium formulation and the calcium sulfonate formulation. The lithium formulation comprises lithium soap, lithium and lithium complex greases, lithium 12-hydroxystearate, lithium hydroxide/calcium hydroxide with 12-hydroxystearic acid, or a combination thereof. The calcium sulfonate formulation includes calcite converted sulfonates with a total base number (TBN) about 300 or about 400. The process further includes adding oil additions. The process further includes adding additives. The additives are added once the lithium formulation and the calcium sulfonate formulation are cooled to below about 180° F.

The lithium formulation is prepared by adding an oil to a first container; dissolving lithium hydroxide in water and adding dissolved lithium hydroxide to the first container to form a first mixture; mixing the first mixture to emulsify the water and the oil; heating the mixed first mixture to about 180° F.; adding fatty acids to the heated first mixture to form a second mixture; heating the second mixture to about 220° F. and maintaining the temperature for about one hour to form a dehydrated mixture; heating the dehydrated mixture to a temperature about 400° F. to 420° F. to form a molten mixture; and cooling the molten mixture to form a lithium based grease.

The calcium sulfonate formulation is prepared by adding an oil to a second container; adding amorphous calcium sulfonate and a transformation-promoting material to the second container to form a first mixture; heating the first mixture to about 200° F. to form a transformed mixture; and heating the transformed mixture to about 300° F. and maintaining the temperature for about one hour to form a calcium sulfonate based grease.

Test Results

The lithium/calcium sulfonate mixed base lubricating greases prepared according to the process 300 are subjected to structural testing, tribological testing, and corrosion testing. Table 4 summarizes structural testing results according to D1403, D1831, D1478, D8022, and D2265. Values in Table 4 are stated in SI units. Sample Nos. 1-1 through 1-7 are varied blends of mineral oil based lithium complex grease with mineral oil based calcium sulfonate grease. In Tables 4-6, the proportion of calcium sulfonate increases from 0% in sample 1-1 sequentially to 15%, 30%, 50%, 70%, 85%, and 100% respectively. Sample Nos. 2-1 through 2-7 are grease blends with synthetic oil based lithium complex grease with synthetic oil based calcium sulfonate grease.

TABLE 4

| No. | ASTM D1403 ¼ 60 Pen | ASTM D1831 Roll Stability | ASTM D8022 10% Wet Roll Stability | ASTM D2265 Drop Pt (F.) | ASTM D1478 Low Temp. Torque (start/final, mN · m) |
|---|---|---|---|---|---|
| 1-1 | 266 | −3.75% | +17.1% | >288° C. | 298.1/31.833 |
| 1-2 | 255.2 | +6.39% | +8.35% | >288° C. | 208.364/17.364 |
| 1-3 | 272.7 | −0.44% | +3.22% | 238.7° C. | 167.849/8.682 |
| 1-4 | 289 | −1.66% | −0.45% | 229.3° C. | 162.061/17.364 |
| 1-5 | 296.5 | −3.37% | −10.12% | 251° C. | 159.167/20.258 |
| 1-6 | 290.3 | −3.48% | −15.50% | 278.7° C. | 176.531/14.470 |
| 1-7 | 277 | −5.60% | −18.10% | >288° C. | 237.30/8.68 |
| 2-1 | 282.2 | −1.01% | +9.45% | >288° C. | 83.92/26.05 |
| 2-2 | 291.5 | −1.27% | +6.42% | >288° C. | 57.879/20.258 |
| 2-3 | 296.5 | +2.53% | −3.81% | 252.7° C. | 57.879/17.364 |
| 2-4 | 292.7 | +2.56% | −5.61% | 266° C. | 54.985/14.470 |
| 2-5 | 284 | +3.52% | −11.31% | >288° C. | 60.773/37.621 |
| 2-6 | 280.4 | +3.96% | −14.51% | >288° C. | 66.561/43.409 |
| 2-7 | 269 | +4.21% | −17.57% | >288° C. | 75.24/8.68 |

Table 5 summarizes tribological testing results according to ASTM D2266 and D2596. Values in Table 5 are stated in SI units.

TABLE 5

Tribological Testing

| No. | ASTM D2266 4 Ball Wear Scar Diameter (mm) | ASTM D2596 4 Ball Weld Wear Scar Diameter (mm) 50 kg | 63 kg | 80 kg | 126 kg |
|---|---|---|---|---|---|
| 1-1 | 0.64 | 0.59 | 2.22 | 2.02 | 2.92 |
| 1-2 | 0.52 | 0.31/0.30 | 0.38/0.36 | 2.3/2.2 | 2.3/2.2 |
| 1-3 | 0.52 | NA | 0.38/0.25 | 1.7/1.7 | 2.1/2.1 |
| 1-4 | 0.51 | NA | 0.38/0.37 | 0.40/0.47 | 1.8/1.8 |
| 1-5 | 0.46 | NA | NA | 0.40/0.39 | 0.41/0.41 |
| 1-6 | 0.38 | NA | 0.38/0.42 | 0.55/0.63 | 1.4/1.6 |
| 1-7 | 0.34 | 0.33 | 0.37 | 0.53 | 0.75 |
| 2-1 | 0.685 | 0.405 | 0.596 | 1.927 | 2.395 |
| 2-2 | 0.693 | 0.322 | 0.321 | 1.770 | 2.440 |
| 2-3 | 0.675 | 0.317 | 0.338 | 1.700 | 2.220 |
| 2-4 | 0.553 | 0.494 | 0.359 | 0.354 | 2.143 |
| 2-5 | 0.527 | 0.345 | 0.378 | 0.431 | 2.210 |
| 2-6 | 0.403 | 0.339 | 0.318 | 0.337 | 1.920 |
| 2-7 | 0.350 | 0.313 | 0.356 | 0.686 | 1.900 |

| No. | ASTM D2596 4 Ball Weld Wear Scar Diameter (mm) 160 kg | 200 kg | 250 kg | 315 kg | 400 kg | LNSL |
|---|---|---|---|---|---|---|
| 1-1 | Weld | | | | | <50 kg |
| 1-2 | 2.8/2.6 | 3.3/3.6 | Weld | | | 63 kg |
| 1-3 | 2.4/2.8 | 2.9/2.8 | Weld | | | 63 kg |
| 1-4 | 2.1/2.2 | 2.8/2.3 | 2.6/2.5 | Weld | | 63 kg |
| 1-5 | 2.2/2.2 | 2.7/2.3 | 2.4/2.7 | 2.9/2.5 | Weld | 80 kg |
| 1-6 | 2.1/2.0 | 2.2/2.6 | 2.5/2.4 | 2.8/2.5 | Weld | 63 kg |
| 1-7 | 1.00 | 1.93 | 2.12 | 2.62 | Weld | 63 |

TABLE 5-continued

| Tribological Testing | | | | | | |
|---|---|---|---|---|---|---|
| 2-1 | 3.27 | Weld | | | | <50 kg |
| 2-2 | 2.780 | 3.330 | Weld | | | 63 kg |
| 2-3 | 2.680 | 2.970 | Weld | | | 63 kg |
| 2-4 | 2.304 | 2.561 | 3.094 | Weld | | 80 kg |
| 2-5 | 2.410 | 3.180 | 3.690 | Weld | | 63 kg |
| 2-6 | 2.240 | 2.410 | 2.780 | Weld | | 80 kg |
| 2-7 | 2.051 | 2.119 | 2.653 | 3.113 | Weld | 63 kg |

Table 6 summarizes tribological testing results according to ASTM D5706B, D7594, and D5707. Values in Table 6 are obtained based on SRV measures (e.g., measures of the physical interaction between a lubricant and two specimens in a loaded contact in either rotation or linear oscillatory motion) and stated in SI units.

TABLE 6

| | Tribological Testing by SRV | | |
|---|---|---|---|
| No. | ASTM D5706B Step Load (N) | ASTM D7594 Fretting (CoF-final/scar diameter) | ASTM D5707 Wear (CoF-min/scar diameter) |
| 1-1 | 900 | 0.418/0.507 mm | 0.143/0.802 mm |
| 1-2 | 500 | 0.127/0.305 mm | 0.118/0.500 mm |
| 1-3 | 500 | 0.131/0.298 mm | 0.125/0.413 mm |
| 1-4 | 1650 | 0.128/0.301 mm | 0.124/0.391 mm |
| 1-5 | 1850 | 0.127/0.319 mm | 0.124/0.396 mm |
| 1-6 | 200/run-in fail | 0.124/0.303 mm | 0.119/0.388 mm |
| 1-7 | Failed at run-in | 0.111/0.269 mm | 0.119/0.397 mm |
| 2-1 | 300 | Failed at run-in | Fail/~1 mm |
| 2-2 | 150 | 0.129/0.316 | 0.118/0.635 mm |
| 2-3 | 500 | 0.130/0.316 mm | 0.118/0.403 mm |
| 2-4 | 650 | 0.126/0.326 mm | 0.108/0.407 mm |
| 2-5 | 1650 | 0.130/0.309 mm | 0.106/0.394 mm |
| 2-6 | 2000 | 0.128/0.328 mm | 0.115/0.408 mm |
| 2-7 | Failed at run-in | 0.152/0.342 mm | 0.113/0.402 mm |

To the extent that the term "includes" or "including" is used in the specification or the claims, it is intended to be inclusive in a manner similar to the term "comprising" as that term is interpreted when employed as a transitional word in a claim. As used in the specification and the claims, the singular forms "a," "an," and "the" include the plural. Furthermore, to the extent that the term "or" is employed (e.g., A or B), it is intended to mean "A or B or both." Finally, where the term "about" or "approximately" is used in conjunction with a number, it is intended to include within ±5%, within ±4%, within ±3%, within ±2%, within ±1%, or within ±0.5% of the number. The term "substantially" encompasses a range that is largely (anywhere a range within or a discrete number within a range of 95% and 105%, a range of 97% and 103%, a range of 98% and 102%, or a range of 99% and 101%), but not necessarily wholly, that which is specified. It encompasses all but an insignificant amount.

As stated above, while the present application has been illustrated by the description of embodiments, and while the embodiments have been described in considerable detail, it is not the intention to restrict or in any way limit the scope of the appended claims to such detail. Additional advantages and modifications will readily appear to those skilled in the art, having the benefit of this application. Therefore, the application, in its broader aspects, is not limited to the specific details and illustrative examples shown. Departures may be made from such details and examples without departing from the spirit or scope of the general inventive concept.

The invention claimed is:

1. A method for forming a lubricating grease, comprising:
preparing a lithium formulation;
cooling the lithium formulation to about 175 degree Celsius (C);
preparing a calcium sulfonate formulation comprising at least one of a calcium sulfonate grease and a calcium sulfonate complex variation; and
mixing the lithium formulation and the calcium sulfonate formulation.

2. The method of claim 1, comprising adding additional oil.

3. The method of claim 1, comprising adding additives.

4. The method of claim 3, comprising adding the additives once the lithium formulation and the calcium sulfonate formulation are cooled to below 80° C.

5. The method of claim 1, wherein the lithium formulation comprises at least one of a lithium-based grease and a lithium complex variation.

6. The method of claim 5, wherein the lithium-based grease is made of a base oil of about 80 weight % (wt. %) to about 92 wt. %, about 1 wt. % to about 3 wt. % first lithium hydroxide, about 6 wt. % to about 12 wt. % first fatty acid, and wherein the lithium complex variation is made of about 80 wt. % to about 92 wt. % base oil, about 1 wt. % to about 3 wt. % first lithium hydroxide, about 6 wt. % to about 12 wt. % first fatty acid, about 1 wt. % to about 3 wt. % second lithium hydroxide, and about 6 wt. % to about 12 wt. % second fatty acid.

7. The method of claim 1, wherein the calcium sulfonate grease is made of about 60 wt. % base oil, about 30 wt. % calcium sulfonate, and about 10 wt. % gelling promoter, and wherein the calcium sulfonate complex variation is made of about 51.6 wt. % base oil, about 30 wt. % calcium sulfonate, about 10 wt. % gelling promoter, about 4.8 wt. % fatty acid, about 1.4 wt. % calcium hydroxide, and about 2.2 wt. % 12-hydroxystearic acid.

8. A lubricating grease formed by the method of claim 7.

9. The lubricating grease of claim 8, wherein the lithium formulation comprises lithium soap, lithium and lithium complex greases, lithium 12-hydroxystearate, lithium hydroxide/calcium hydroxide with 12-hydroxystearic acid, or a combination thereof.

10. The lubricating grease of claim 8, wherein the calcium sulfonate formulation comprises calcite converted sulfonates with a total base number (TBN) about 300 or about 400.

11. A method for forming a lubricating grease, comprising:
preparing a lithium formulation by forming a thickened lithium-based grease structure or a thickened lithium complex variation structure;
cooling the lithium formulation to about 175 degree Celsius (° C.);
preparing a calcium sulfonate formulation separately from the lithium formulation by:
mixing an amorphous calcium sulfonate and an oil;
adding an additional oil and mixing a gelling promotor to form an emulsion;
heating the emulsion to form a first transformed mixture;
heating the first transformed mixture to form a first dehydrated mixture; and
cooling and adding additional oil to the first dehydrated mixture to form a calcium sulfonate grease; and mixing the lithium formulation and the calcium sulfonate grease after the lithium formulation has been cooled to about 175° C.

12. The method of claim 11, comprising preparing the lithium formulation by:

mixing and heating an oil;

mixing a first slurry comprising lithium hydroxide and water;

mixing the mixed slurry and a first fatty acid and the heated oil to form a first mixture;

heating the first mixture to form a dehydrated first mixture;

heating the dehydrated first mixture to form a first molten mixture; and cooling the first molten mixture to form a thickened lithium-based grease structure.

13. The method of claim 11, comprising preparing the lithium formulation by:

mixing and heating an oil;

mixing a first slurry comprising lithium hydroxide and water;

mixing the mixed slurry and a first fatty acid and the heated oil to form a first mixture;

heating the first mixture to form a dehydrated first mixture;

heating and subsequently cooling the dehydrated first mixture;

mixing and adding a second fatty acid and a second slurry comprising a second lithium hydroxide and water to form a second mixture;

heating the second mixture to form a dehydrated second mixture;

heating the dehydrated second mixture to form a molten second mixture; and cooling the molten second mixture to form a thickened lithium complex variation structure.

14. The method of claim 1, wherein preparing the calcium sulfonate formulation comprises:

mixing an amorphous calcium sulfonate and an oil;

adding an additional oil and mixing a gelling promotor to form an emulsion;

adding complexing agents to the emulsion;

heating the complexing agents and the emulsion to form a second transformed structure;

adding calcium hydroxide in water to the second transformed structure to form a mixture;

heating the mixture to form a second dehydrated mixture;

adding and mixing 12-hydroxy stearic acid with the second dehydrated mixture; and cooling and adding additional oil to the second dehydrated mixture to form a calcium sulfonate complex variation structure.

15. The method of claim 11, wherein the lithium-based grease structure is made of a base oil of about 80 weight % (wt. %) to about 92 wt. %, about 1 wt. % to about 3 wt. % first lithium hydroxide, about 6 wt. % to about 12 wt. % first fatty acid, and wherein the lithium complex variation structure is made of about 80 wt. % to about 92 wt. % base oil, about 1 wt. % to about 3 wt. % first lithium hydroxide, about 6 wt. % to about 12 wt. % first fatty acid, about 1 wt. % to about 3 wt. % second lithium hydroxide, and about 6 wt. % to about 12 wt. % second fatty acid.

16. The method of claim 11, wherein the calcium sulfonate grease is made of about 60 wt. % base oil, about 30 wt. % calcium sulfonate, and about 10 wt. % gelling promoter.

17. A method for forming a lubricating grease, comprising:

preparing a lithium formulation by forming a thickened lithium-based grease structure or a thickened lithium complex variation structure;

cooling the lithium formulation to about 175 degree Celsius (° C.);

preparing a calcium sulfonate formulation separately from the lithium formulation, wherein the calcium sulfonate formulation comprises at least one of a calcium sulfonate grease and a calcium sulfonate complex variation; and mixing the lithium formulation and the calcium sulfonate formulation after the lithium formulation has been cooled to about 175° C.

* * * * *